US011504567B1

(12) United States Patent
Hong

(10) Patent No.: US 11,504,567 B1
(45) Date of Patent: Nov. 22, 2022

(54) WEIGHT-ADJUSTABLE DUMBBELL

(71) Applicant: Guonian Hong, Zhejiang (CN)

(72) Inventor: Guonian Hong, Zhejiang (CN)

(73) Assignee: Guonian Hong, Ningbo (CN)

( * ) Notice: Subject to any disclaimer, the term of this patent is extended or adjusted under 35 U.S.C. 154(b) by 0 days.

(21) Appl. No.: 17/588,345

(22) Filed: Jan. 31, 2022

(30) Foreign Application Priority Data

Dec. 24, 2021 (CN) ..... 202123299925.5

(51) Int. Cl.
*A63B 21/072* (2006.01)
*A63B 21/075* (2006.01)

(52) U.S. Cl.
CPC ..... *A63B 21/0728* (2013.01); *A63B 21/072* (2013.01); *A63B 21/075* (2013.01); *A63B 21/0726* (2013.01)

(58) Field of Classification Search
CPC .... A63B 21/00058–00065; A63B 21/072–075
See application file for complete search history.

(56) References Cited

U.S. PATENT DOCUMENTS 7,261,678 B2 * 8/2007 Crawford ..... A63B 71/0054 482/94
8,529,415 B2 * 9/2013 Svenberg ..... A63B 21/075 482/106
9,669,252 B2 * 6/2017 Svenberg ..... A63B 21/075
2009/0305852 A1 * 12/2009 Hoglund ..... A63B 21/0728 482/107
2010/0323856 A1 * 12/2010 Svenberg ..... A63B 21/075 482/108
2022/0088432 A1 * 3/2022 Wang ..... A63B 71/0036

FOREIGN PATENT DOCUMENTS

CN 203169903 U * 9/2013

* cited by examiner

*Primary Examiner* — Garrett K Atkinson
*Assistant Examiner* — Kathleen M Fisk

(57) ABSTRACT

Provided is a weight-adjustable dumbbell, including a grip bar assembly, a dumbbell seat, a plurality of dumbbell discs placed on the dumbbell seat; the grip bar assembly includes a plurality of hanging discs arranged adjacent to each other and are rotated synchronously, and the hanging discs are rotated relative to the dumbbell discs to setting positions to engage with or disengage from the dumbbell discs. The grip bar assembly also includes at least one stopping mechanism, each stopping mechanism includes at least one locking component, and the dumbbell seat is provided with a limiting hole for the locking component to be engaged with. When the hanging discs are rotated to a setting position, the locking component is disengaged from the limiting hole to maintain an unlocked state. When the hanging discs are rotated between two setting positions, the locking component is inserted into the limiting hole to maintain a locked state.

3 Claims, 11 Drawing Sheets

A

B

WEIGHT-ADJUSTABLE DUMBBELL

CROSS-REFERENCE TO RELATED APPLICATION

The present application is based on and claims the priority benefits of China application No. 202123299925.5, filed on Dec. 24, 2021. The entirety of the above-mentioned patent application is hereby incorporated by reference herein and made a part of this specification.

TECHNICAL FIELD

The present application relates to the technical field of dumbbell, and particularly to a weight-adjustable dumbbell.

BACKGROUND ART

Dumbbell is a common fitness equipment, which is deeply loved by fitness athletes because of its small space and convenient use.

The common dumbbells include weight-fixed dumbbells and weight-adjustable dumbbells, among which the weight-adjustable dumbbells can adjust the weight of dumbbells, thereby can meet the needs of different training intensity. At present, there is a weight-adjustable dumbbell, which includes a grip bar assembly, a plurality of dumbbell discs and a dumbbell seat for supporting the dumbbell discs. Hanging discs are arranged at both ends of the grip bar assembly. When the weight of the dumbbell needs to be adjusted, the grip bar assembly is placed on the dumbbell seat, and the user can engage with or disengage from the dumbbell discs by rotating the hanging discs to different positions, thereby adjust the number of dumbbell discs connected to the grip bar assembly and realize the effect of adjusting the weight of the dumbbell discs.

However, in the above technology, when the user rotates the hanging disc, if the hanging disc does not rotate to the setting position, that is, when the hanging disc is rotated between two setting positions, the hanging disc and the dumbbell disc will be in a semi-engaged state. Although the grip bar assembly can drive the dumbbell disc to be lifted together, the dumbbell disc is easy to disengage from the grip bar assembly in the lifting process, which will cause injury to the user, and there are certain potential safety hazards.

SUMMARY

In order to reduce the possibility of injury to users caused by dumbbell discs falling out during fitness, the present application provides a weight-adjustable dumbbell.

A weight-adjustable dumbbell provided in the present application adopts the following technical solution:

a weight-adjustable dumbbell includes a grip bar assembly, a dumbbell seat, a plurality of dumbbell discs placed on the dumbbell seat; the grip bar assembly includes a plurality of hanging discs which are arranged adjacent to each other and are rotated synchronously, and the hanging disc is adapted to be rotated relative to dumbbell disc to a setting position to engage with or disengage from the dumbbell disc.

The grip bar assembly also includes at least one stopping mechanism, each stopping mechanism includes at least one locking component, and the dumbbell seat is provided with a limiting hole for the locking component to be engaged with. When the hanging disc is rotated at the setting position, the locking component is disengaged from the limiting hole to maintain an unlocked state. When the hanging disc is rotated between two setting positions, the locking component is inserted into the limiting hole to maintain a locked state.

In the above technical solution, the dumbbell seat supports the dumbbell disc, and the hanging disc and the dumbbell disc can rotate relative to each other to adjust the position to choose the dumbbell disc for fitness. When the hanging disc is rotated at the setting position to engage with the dumbbell disc, the locking component can disengage from the limiting hole and is in an unlocked state, and the user can lift the grip bar assembly and the dumbbell disc from the dumbbell seat for fitness. When the hanging disc is not rotated at the setting position to semi-engage with the dumbbell disc, the locking component can be inserted in the limiting hole and is in an locked state, and the user is not easy to lift the grip bar assembly and the dumbbell disc from the dumbbell seat for fitness.

Therefore, the users can not easy to lift the grip bar assembly from the dumbbell seat when the hanging disc and the dumbbell disc are in the semi-engage state, so it can reduce the risk of injury to users caused by dumbbell discs falling out because the dumbbell disc and the hanging disc are in the semi-engage state during in use, and also make the dumbbell more safe during in use.

In some embodiments, each stopping mechanism also includes an inner end cap and a stopping plate. The inner end cap is clamped on the dumbbell seat and is rotated relative to the hanging disc, and the stopping plate is provided in the inner end cap and is rotated synchronously with the hanging disc. The inner end cap is formed with a guiding hole, and the locking component is extended through the guiding hole and slidably abutted against the stopping plate. The dumbbell seat is formed with a limiting hole at a position relative to the guiding hole, and the stopping plate rotationally drives the locking component to slide back and forth in the guiding hole to engage with or disengage from the limiting hole.

In the above technical solution, the guiding hole can accommodate and limit the locking component. The stopping plate can synchronously rotate and slide to abut against the locking component, so that it can drive the locking component to move back and forth in the guiding hole. When the dumbbell disc is selected, the grip bar assembly is placed on the dumbbell seat, and the guiding hole is aligned with the limiting hole to facilitate the insertion/disengagement of the locking component from the limiting hole.

In some embodiments, the stopping plate is evenly provided with a plurality of convex blocks along the circumferential direction, and an escape groove is formed between each two adjacent convex blocks. The locking component includes an abutting portion abutted against the stopping plate. When the abutting portion abuts against the convex block, the locking component is inserted into the limiting hole. When the abutting portion abuts against the bottom wall of the escape groove, the locking component disengages from the limiting hole.

In the above technical solution, when the abutting portion abuts against the convex block, the convex block extrudes the locking component out of the guiding hole and inserts it into the limiting hole to in a locked state. When the abutting portion abuts against the bottom wall of the abutting portion, the locking component disengages from the limiting hole and is in an unlocked state. The abutting portion is arc-shaped to facilitate sliding abutting against the stopping plate.

In some embodiments, the guiding holes are formed along the radial direction of the inner end cap, and the convex blocks are evenly arranged on the circumferential side wall of the stopping plate along the circumferential direction.

In the above technical solution, the guiding holes are formed along the radial direction of the inner end cap, and the convex blocks are evenly arranged on the circumferential side wall of the stopping plate along the circumferential direction, so that the stopping plate can do reciprocating motion along the radial direction of the inner end cap.

In some embodiments, the guiding holes are formed along the vertical direction of the cap surface of inner end cap, and the convex blocks are evenly arranged on the plate surface of the stopping plate along the circumferential direction.

In the above technical solution, the guiding holes are formed along the vertical direction of the cap surface of the inner end cap, and the convex blocks are evenly arranged on the plate surface of the stopping plate along the circumferential direction, so that when the stopping plate is rotated, the locking component can be driven to move back and forth along the vertical direction of the cap surface of the inner end cap.

In some embodiments, the locking component includes a locking portion and a resetting portion, the resetting portion is connected to the peripheral side of the locking portion, and the locking portion can be extended through the guiding hole and can slide and engage into the limiting hole. The resetting portion slides and engages in the guiding hole, and drives the locking portion to be reset into the guiding hole.

In the above technical solution, when the locking component moves back and forth, the locking portion can be inserted into or disengaged from the limiting hole. During the rotation of the stopping plate to align the escape groove with the guiding hole, the resetting portion arranged on the peripheral side of the locking portion drives the locking portion to gradually reset into the guiding hole, so that the locking portion is disengaged from the limiting hole.

In some embodiments, the resetting portion includes a connecting section and a limiting section, the limiting section and the locking portion are provided at intervals, and the connecting section is connected between the limiting section and the locking portion. The guiding hole includes a sliding cavity and a limiting cavity which are connected in turn, and the connecting section is slidably extended through the sliding cavity. The limiting section is slidably extended through the limiting cavity, so that the connecting section can be limited to slide out to one side of the sliding cavity away from the limiting cavity.

In the above technical solution, the limiting section is extended through the limiting cavity and abuts against the inner wall of the limiting cavity, and the limiting section is provided with the locking portion at intervals via the connecting section. Therefore, when the locking portion is inserted into the limiting hole, the inner wall of the limiting cavity can compress the resetting portion, so that the resetting portion has elastic potential energy of rebound. After the stopping plate is rotated, the resetting portion can drive the locking portion to reset into the guiding hole.

In some embodiments, the resetting portion is a spring, and the spring sleeves outside the locking portion. One end of the spring is fixedly connected with the inner wall of the guiding hole, and the other end is connected to the locking portion.

In the above technical solution, the resetting portion is a spring sleeved outside the locking portion, during the locking portion inserts the limiting hole, the locking portion stretches or compresses the spring to increase the elastic potential energy of the spring, so that after the stopping plate is rotated, the spring can drive the locking portion to back into the guiding hole.

In some embodiments, the dumbbell seat includes a chassis and at least one supporting frame protruding on the chassis, the supporting frame is provided with a clamping slot for the inner end cap to be engaged with, and the limiting hole is formed on the slot wall of the clamping slot.

In the above technical solution, when the inner end cap is clamped into the clamping slot, the guiding hole on the inner end cap communicates with the limiting hole formed on the inner wall of the clamping slot, so that the locking component can be inserted into or disengaged from the limiting hole, thereby make the stopping mechanism in a locked/unlocked state.

In some embodiments, the grip bar assembly also includes a handle tube, and the stopping plate is clamped and sleeved outside the handle tube and is rotated synchronously with the handle tube.

In the above technical solution, the handle tube and the stopping plat rotate synchronously, so that the handle tube, the stopping plate and the hanging disc rotate synchronously. When in use, the handle tube is rotated, during the hanging disc is rotated and hung the dumbbell disc, the stopping plate is rotated synchronously to drive the locking component to move back and forth, so that the stopping mechanism is locked/unlocked.

In summary, the present application includes at least one of the beneficial effects:

1. In this present application, the hanging disc is rotated to drive the locking component to be inserted or disengaged back and forth from the limiting hole. When the locking component is inserted into the limiting hole, it is not easy for the user to lift the grip bar assembly from the dumbbell seat. When the locking component is disengaged from the limiting hole, the user can lift the grip bar assembly from the dumbbell seat, thereby realize the alternating conversion of locking state and unlocking state. This can reduce the possibility of risk occurrence that the dumbbell disc falls off from the hanging disc to injure the user, because the dumbbell disc is lifted when the hanging disc is half-hung with the dumbbell disc;

2. A plurality of convex blocks are evenly arranged on the outer circumference of the stopping plate. When the convex block abuts against the locking component, the locking component is pushed out by the convex block and inserted into the limiting hole to lock the dumbbell seat and grip bar assembly;

3. The resetting portion drives the locking portion to reset when the stopping plate is rotated to the escape groove to be aligned with the guiding hole. The cooperation between the resetting portion and the stopping plate makes the locking component continuously reciprocating in the guiding hole when the stopping plate is rotated.

DETAILED DESCRIPTION

The present application is further described in detail below in combination with the accompanying drawings 1-18.

Figure 1:
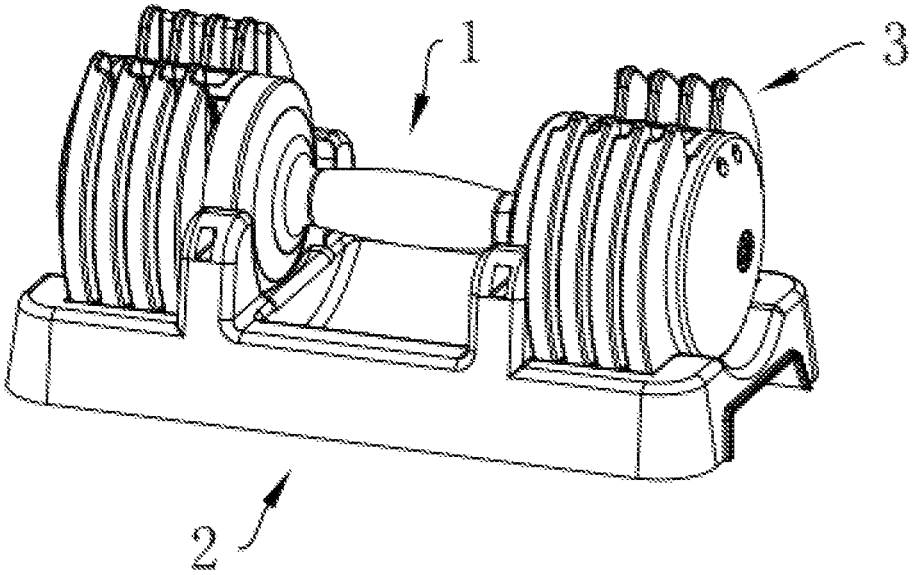
FIG. 1 is an overall schematic diagram of an embodiment of the present application.
Figure 2:
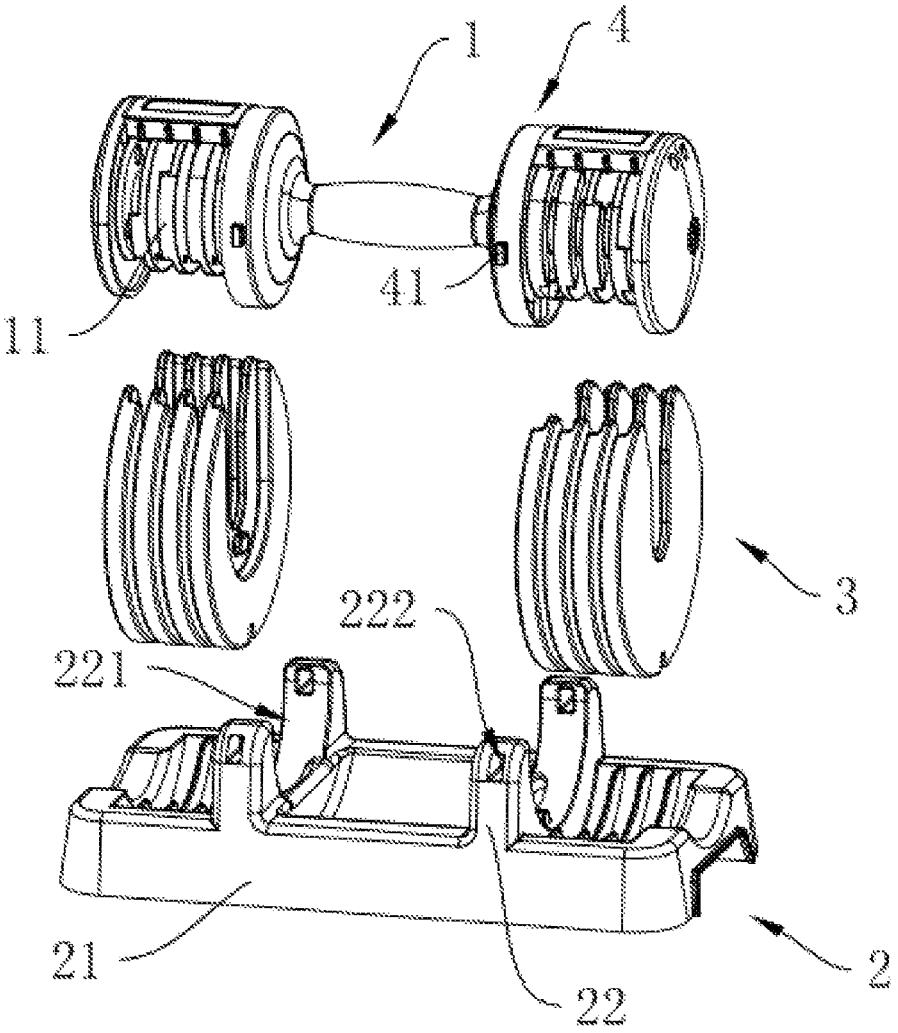
FIG. 2 is an explosion diagram of an embodiment of the present application.

The present application discloses a weight-adjustable dumbbell, referring to FIGS. 1-2, including a grip bar assembly 1, a dumbbell sea 2 and a plurality of dumbbell discs 3 placed on the dumbbell seat 2. The both ends of grip bar assembly 1 is mounted with two groups of hanging disc 11 which are arranged adjacent to each other and are rotated synchronously, and the hanging disc 11 can engage with or disengage from the dumbbell discs 3 by rotating relative to the dumbbell discs 3, thereby adjust to the appropriate position and adapt to different levels of exercise.

Referring to FIG. 2, the grip bar assembly 1 also includes at least one stopping mechanism 4, each stopping mechanism 4 includes at least one locking component 41, and the dumbbell seat 2 is arranged with a limiting hole 222. During the hanging disc 11 is engaged or disengaged from the dumbbell disc 3, when the hanging disc 11 is rotated at the setting position, the locking component 41 can disengage from the limiting hole 222 and is in an unlocked state, and the user can lift the grip bar assembly 1 from the dumbbell seat 2. When the hanging disc 11 is not rotated at the setting position, that is, the hanging disc 11 is rotated between two setting position, the hanging disc 11 is semi-engaged with the dumbbell disc 3, the locking component 41 can be inserted in the limiting hole 222 and is in an locked state, and the user is not easy to lift the grip bar assembly 1 from the dumbbell seat 2.

In particular, the number and position of the stopping mechanism 4 can be adjusted as needed. In this embodiment, one stopping mechanism 4 is arranged corresponding to each group of hanging discs 11, and the two stopping mechanisms 4 are positioned between the two groups of hanging discs 11.

Figure 3:
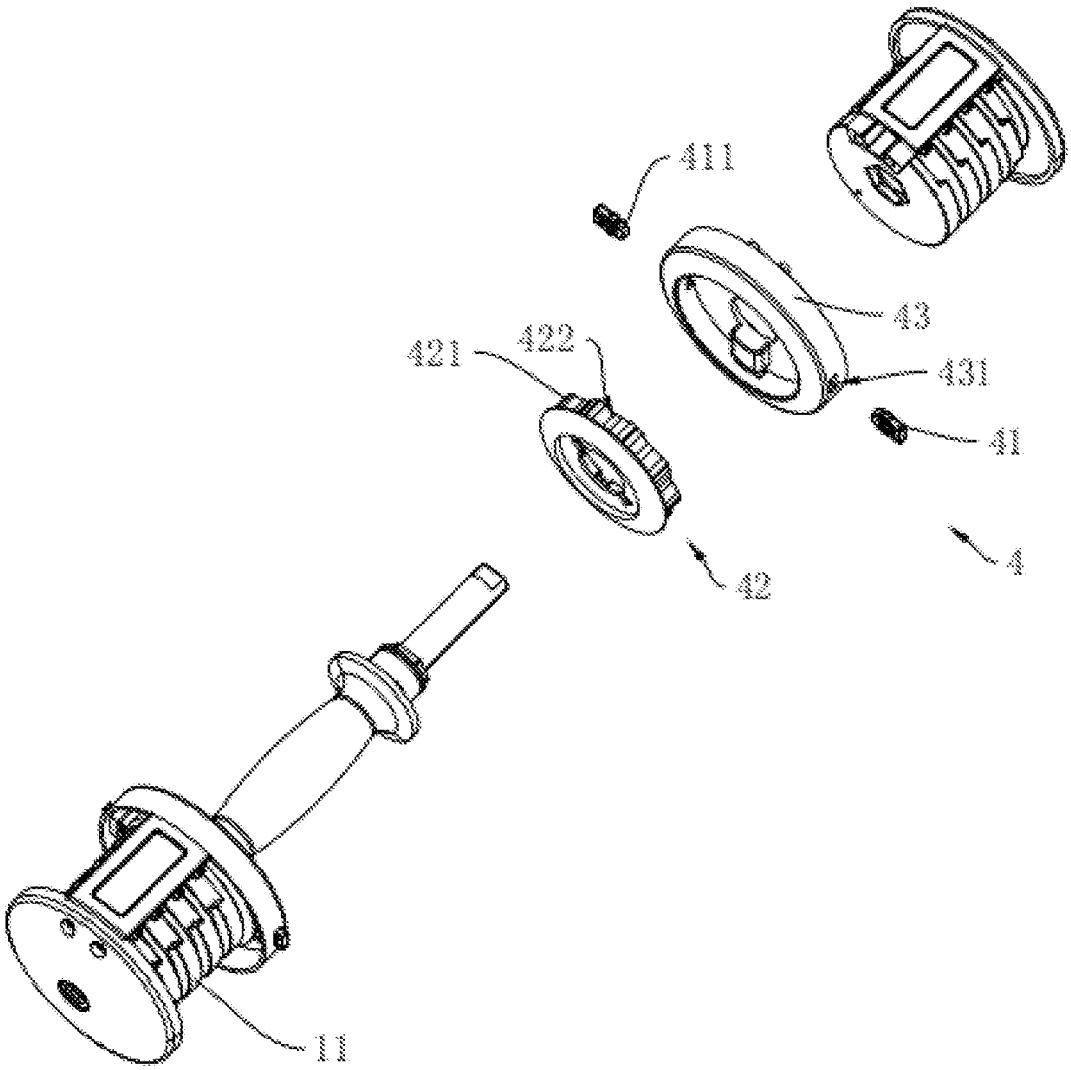
FIG. 3 is a first explosion diagram of a grip bar assembly of an embodiment of the present application.

Referring to FIGS. 2-3, the stopping mechanism 4 also includes an inner end cap 43 and a stopping plate 42. In this embodiment, the inner end cap 43, the stopping plate 42 and the hanging discs 11 are coaxially provided. The inner end cap 43 is rotated relative to the hanging discs 11, and the stopping plate 42 is embedded in the inner end cap 43 and is rotated synchronously with hanging discs 11.

The inner end cap 43 is formed with a guiding hole 431 cooperated with the locking component 41. The locking component 41 extends through the guiding hole 431 and one end of the locking member 41 abuts against the stopping plate 42. At the same time, the dumbbell seat 2 is formed with a clamping slot 221 for the inner end cap 43 to be engaged with, and the limiting hole 222 is formed on the slot wall of the clamping slot 221. When the inner end cap 43 is clamped into the clamping slot 221, the guiding hole 431 is aligned and communicates with the limiting hole 222, thereby facilitate the accurate insertion or disengagement of the locking component 41 from the limiting hole 222.

In this application, the dumbbell seat 2 can be a plate, and the clamping slot 222 is directly formed at the top of the plate. In addition, the dumbbell seat 2 also can be a seat including a chassis 21 and a supporting frame 22, and the supporting frame 22 is protruded on the chassis 21 and the clamping slot 221 is formed in the middle of the supporting frame 22. The number of the supporting frame 22 specifically depends on the number of the inner end cap 43. In this embodiment, one supporting frame 22 is arranged corresponding to each of the two inner end caps 43 of the dumbbell seat 2.

In particular, the stopping plate 42 is evenly arranged with a plurality of convex blocks 421 along the circumferential direction, and an escape groove 422 is formed between each two adjacent convex blocks 421. The locking component 41 includes an abutting portion 411 abutted against the stopping plate 42. When the stopping plate 42 is rotated, the abutting joint between the abutting portion 411 and the stopping plate 42 fluctuates evenly, so that the locking component 41 can slide back and forth in the guiding hole 431. When the abutting portion 411 abuts against the convex block 421, the locking component 41 is inserted into the limiting hole 222 with the drive of the convex block 421. When the abutting portion 411 abuts against the bottom wall of the escape groove 422, the locking component 41 disengages from the limiting hole 222.

Figure 4:
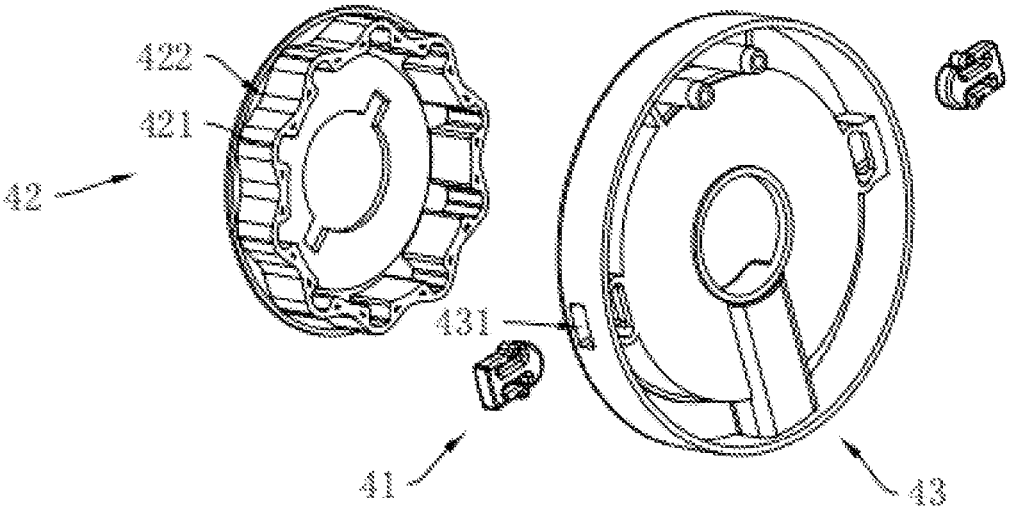
FIG. 4 is a schematic diagram of a stopping mechanism according to the first embodiment of the present application.
Figure 5:
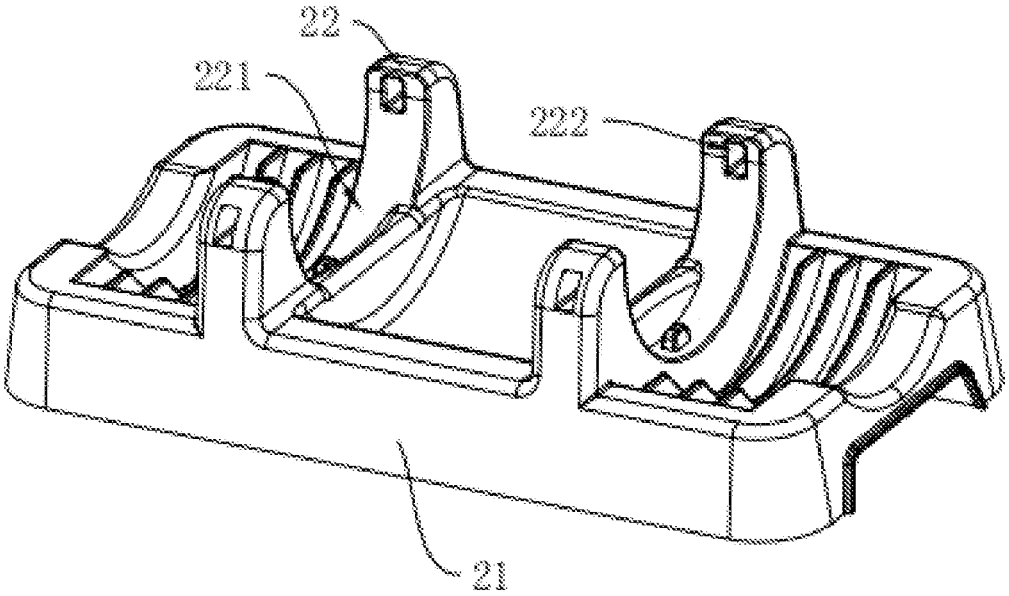
FIG. 5 is a schematic diagram of a dumbbell seat according to the first embodiment of the present application.

The first embodiment of the present application is:

referring to FIGS. 4-5, the convex blocks 421 are evenly arranged on the circumferential side wall of the stopping plate 42 along the circumferential direction. The guiding holes 431 are formed along the radial direction of the inner end cap 43, then the locking component 41 extended through the guiding holes 431 can slide back and forth along the radial direction of the inner end cap 43 with the drive of the stopping plate 42. The limiting hole 222 is formed on the inner walls of the opposite sides of the clamping slot 221 to be aligned with the guiding hole 431. When the locking component 41 slides back and forth along the radial direction of the inner end cap 43, the locking component 41 can be inserted into or disengaged from the limiting hole 222.

Figure 6:
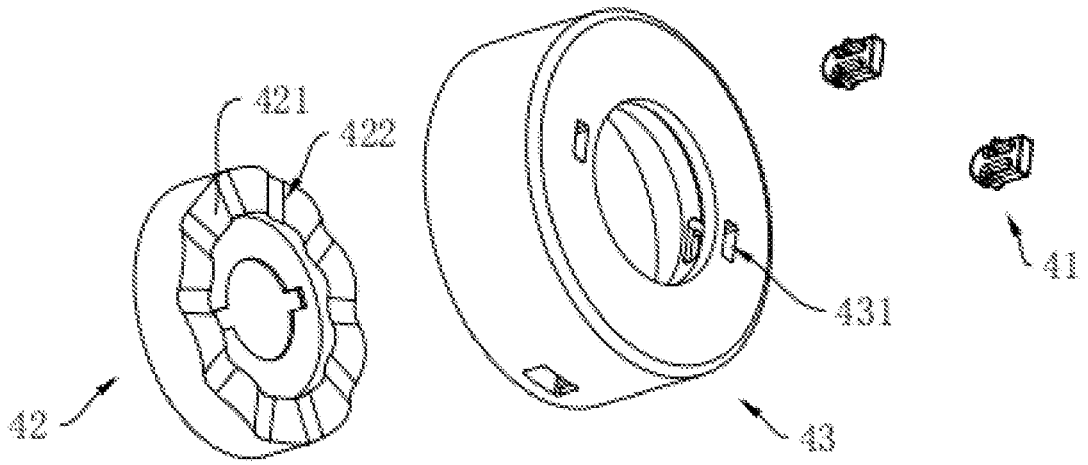
FIG. 6 is a schematic diagram of a stopping mechanism according to the second embodiment of the present application.
Figure 7:
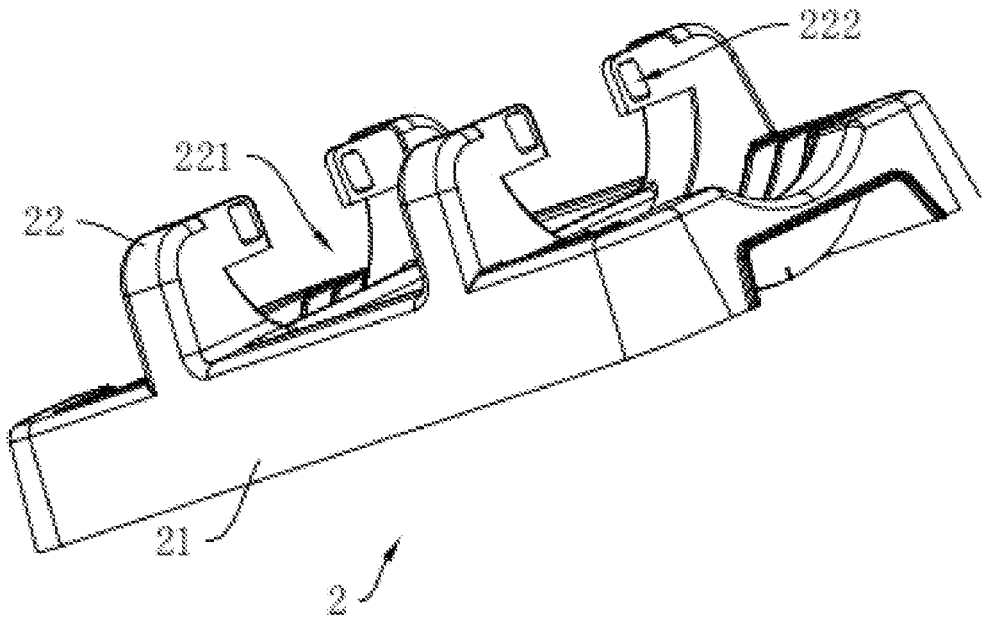
FIG. 7 is a schematic diagram of a dumbbell seat according to the second embodiment of the present application.

The second embodiment of the present application is:

referring to FIGS. 6-7, the convex blocks 421 are evenly arranged on the plate surface of the stopping plate 42 along the circumferential direction. The guiding holes 431 are formed the vertical direction of the cap surface of the inner end cap 43, then after the locking component 41 extended through the guiding holes 431 abuts against the stopping plate 42, it can slide back and forth along the vertical direction of the inner end cap 43 with drive of the stopping plate 42. The limiting hole 222 is formed on one side of the supporting frame 22 facing the plate surface of the inner end cap 43 and aligning with the guiding hole 431. When the locking component 41 slides back and forth with the drive of the stopping plate 42, the locking component 41 can be inserted into or disengaged from the limiting hole 222.

Figure 8:
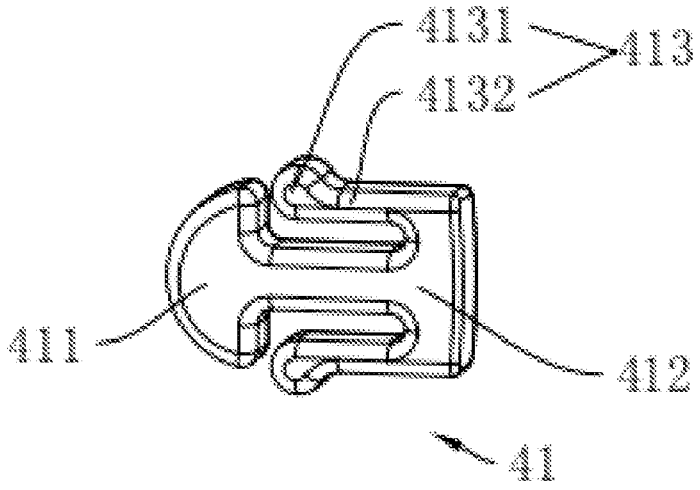
FIG. 8 is a schematic diagram of a locking component of an embodiment of the present application.
Figure 9:
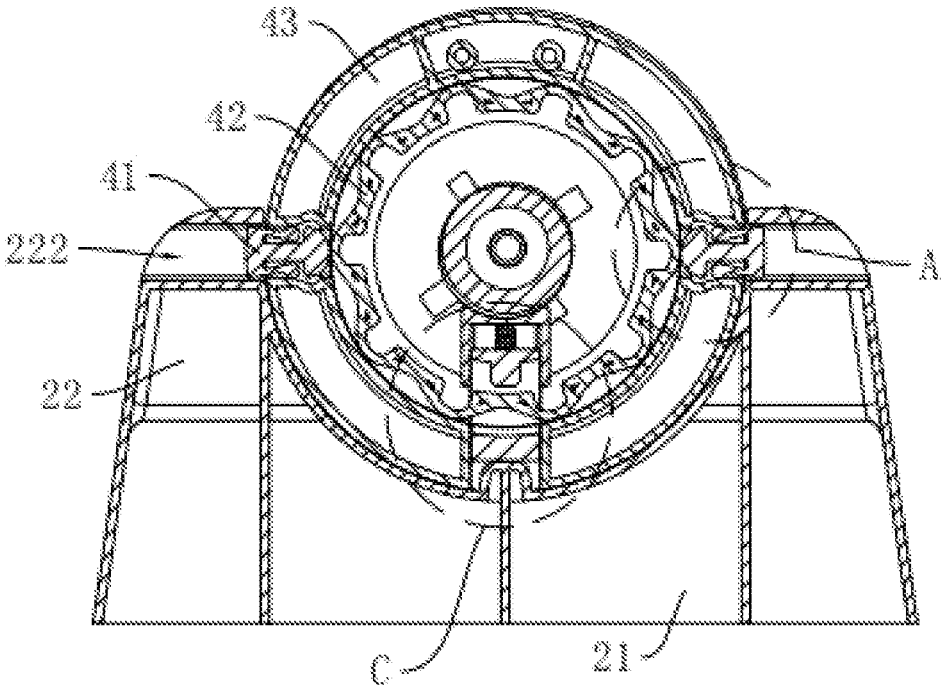
FIG. 9 is installation diagram of a locking component of an embodiment of the present application.
Figure 10:
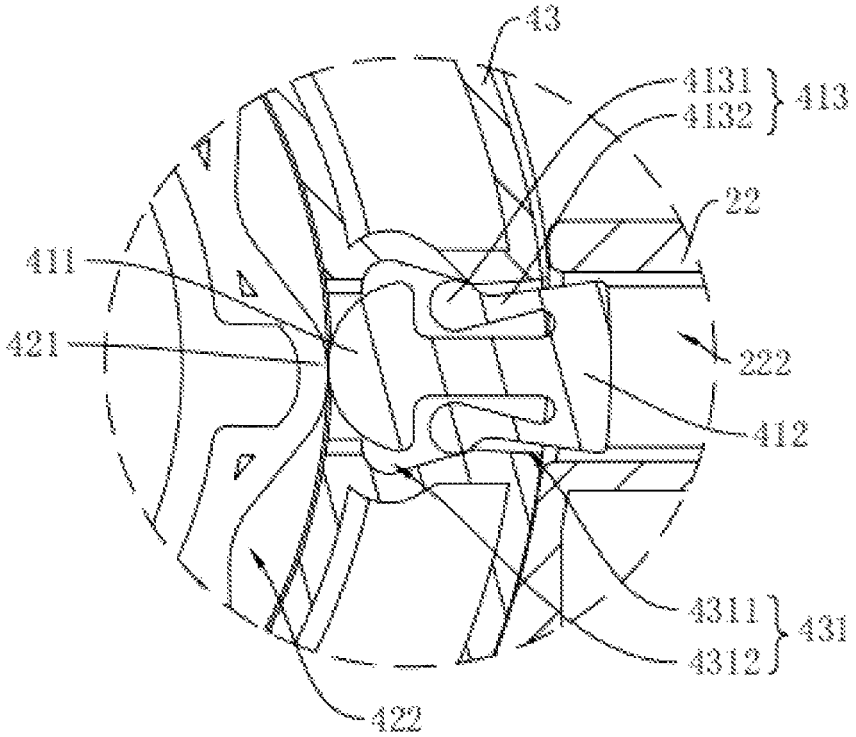
FIG. 10 is an enlarged diagram at A in FIG. 9 of an embodiment of the present application.

Referring to FIGS. 8-10, the locking component 41 further includes a locking portion 412 and a resetting portion 413, and the resetting portion 413 is arranged to the peripheral side of the locking portion 412. In this embodiment, the resetting portions 413 are two, the two resetting portions 413 are symmetrically arranged on the peripheral side of the locking portion 412, which can provide a good reset effect for the locking portion 412.

In particular, the resetting portion 413 includes a limiting section 4131 and a connecting section 4132, the limiting section 4131 integrally formed on the peripheral side of the locking portion 412, the limiting section 4131 and the locking portion 412 are provided at intervals. The connecting section 4132 is connected between the limiting section 4131 and the locking portion 412 to facilitate the elastic reset of the reset unit 413. The guiding hole 431 includes a sliding cavity 4311 and a limiting cavity 4312, the sliding cavity 4311 penetrates the outer peripheral surface of the inner end cap 43, and the limiting cavity 4312 is positioned on the side of the sliding cavity 4311 facing the stopping plate 42. The diameter of the limiting cavity 4312 is larger than that of the sliding cavity 4311, and the limiting section 4131 abuts against the inner wall of the limiting cavity 4312.

When the convex block 421 abuts against the abutting portion 411, the locking portion 412 slides into the limiting hole 222 through the sliding cavity 4311, and the limiting section 4131 compresses and contracts to the side close to the locking portion 412 under the limit of the inner wall of the limiting cavity 4312, thereby have rebound elastic potential energy. As the stopping plate 42 is rotated to align the escape groove 422 with the guiding hole 431, the locking portion 412 is reset along the limiting cavity 4312 driven by the limiting section 4131.

Figure 11:
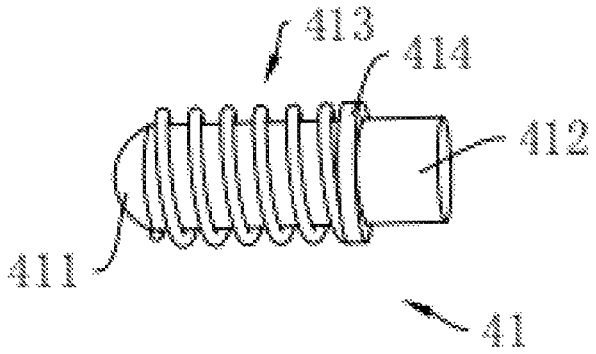
FIG. 11 is a schematic diagram of a locking component according to a third embodiment of the present application.
Figure 12:
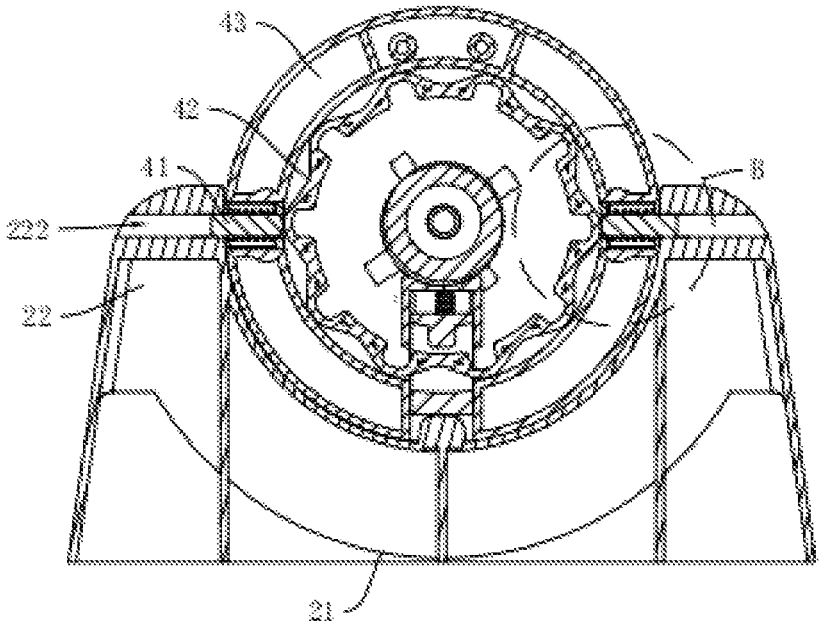
FIG. 12 is an installation diagram of a locking component according to the third embodiment of the present application.
Figure 13:
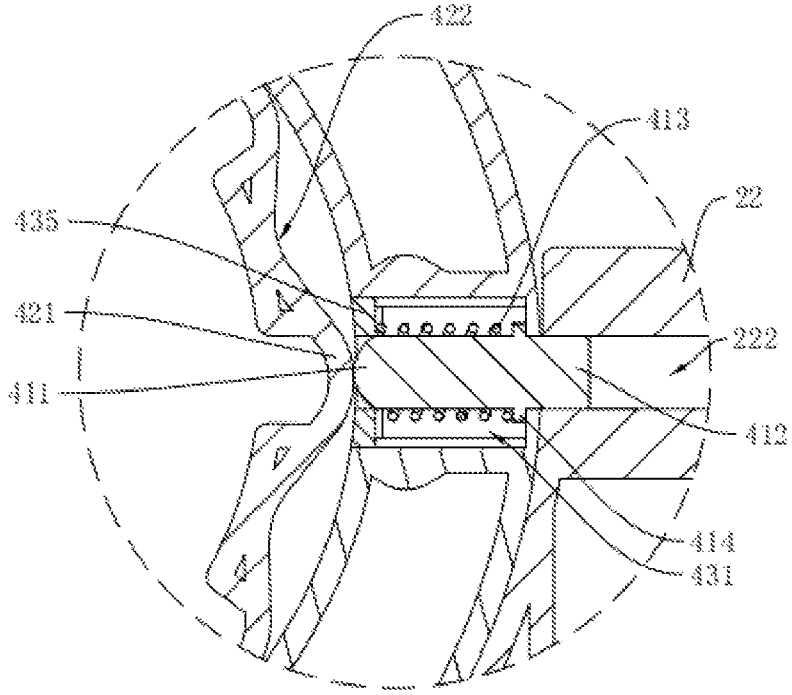
FIG. 13 is an enlarged diagram at B in FIG. 12 of an embodiment of the present application.

The third embodiment of the present application is:

referring to FIGS. 11-13, the resetting portion 413 is a spring sleeved outside the locking portion 412. The outer circumferential direction of the locking component 41 is integrally formed with a convex ring 414, the inner wall of the guide hole 431 is integrally formed or bonded with a stopping block 435, and the spring is positioned between the convex ring 414 and the stopping block 435. If the spring is a tension spring, the stopping block 435 is positioned between the convex ring 414 and the stopping plate 42. One end of the spring is bonded with the stopping block 435, and the other end faced the supporting frame 22 is welded or bonded with the convex ring 414. If the spring is a compression spring, the convex ring 414 is positioned between the stopping block 435 and the stopping plate 42. Both ends of the compression spring are separately abutted against the stopping block 435 and the convex ring 414. This embodiment takes the tension spring as an example. When the locking portion 412 slides and inserts into the limiting hole 222, the spring is stretched, so that the elastic potential energy of the spring is increased. When the convex block 421 is misaligned with the guiding hole 431, the spring can drive the locking portion 412 retract into the guiding hole 431.

Because of the existence of the convex ring 414, it is difficult for the locking component 41 to directly slide and clamp in the guiding hole 431. Therefore, a mounting hole communicating with the guiding hole 431 can be formed on the inner end cap 43 near the guiding hole 431. After mounting the locking component 41 and the spring into the guiding hole 431, the mounting hole can be closed with a cover plate. Alternatively, the locking component 41 and the spring can be put into the guiding hole 431 from the opening which from guiding hole 431 towards the on the side of the stopping plate 42, and then the stopping block 435 can be bonded to the hole wall of the guiding hole 431. In addition, the locking component 41 and the spring can be installed in the guiding hole 431 in other appropriate ways.

Figure 14:
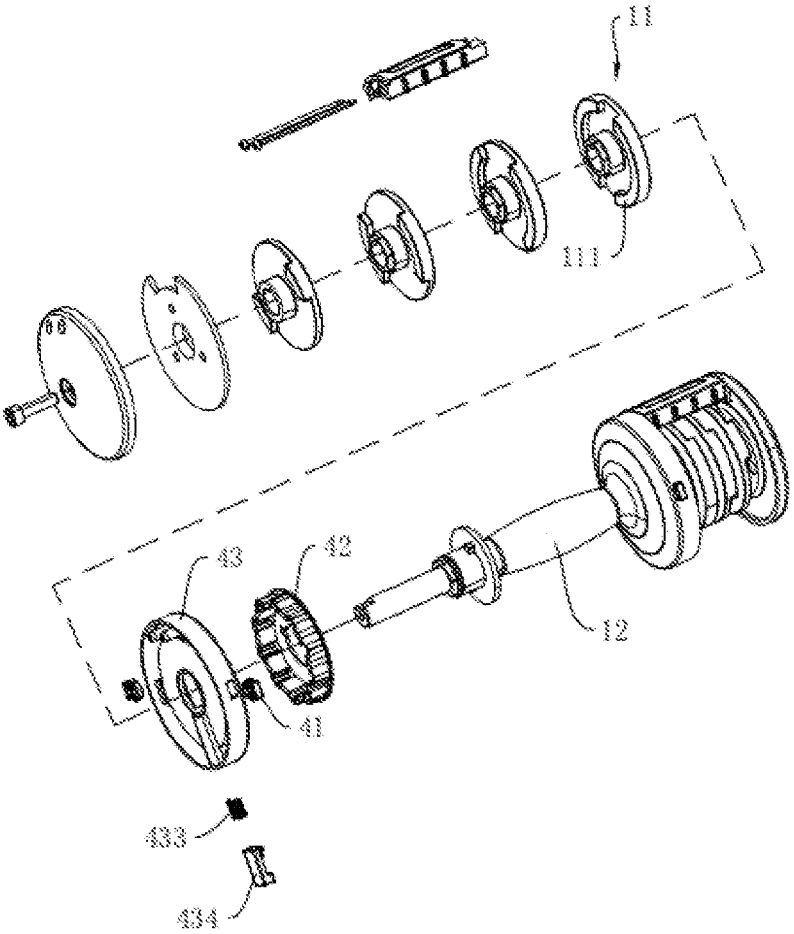
FIG. 14 is a second explosion diagram of the grip bar assembly of an embodiment of the application.

Referring to FIG. 14, the grip bar assembly 1 also includes a handle tube 12, the handle tube 12 is positioned between two groups of the hanging discs 11, and the stopping plate 42 and the inner end cap 43 are sleeved outside the handle tube 12. In particular, the stopping plate 42 is clamped with the handle tube 12, so that the stopping plate 42 can rotate synchronously with the handle tube 12. At the same time, the handle tube 12 is clamped with the hanging discs 11 at the corresponding both ends, so that the handle tube 12, the stopping plate 42 and the hanging discs 11 can rotate synchronously. Turning the handle tube 12 can drive the hanging disc 11 to rotate and engage with or disengage from the dumbbell disc 3, and drive the stopping plate 42 to rotate synchronously, thereby drive the locking component 41 to slide back and forth.

Figure 15:
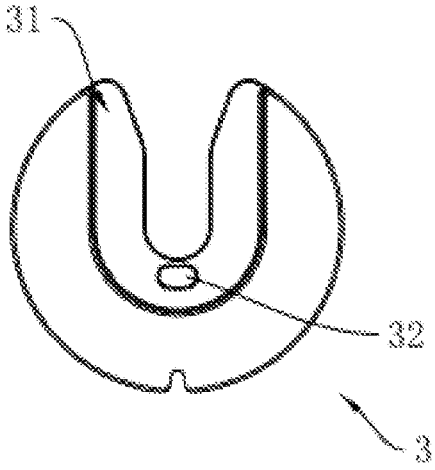
FIG. 15 is a schematic diagram of a dumbbell disc of an embodiment of the present application.
Figure 16:
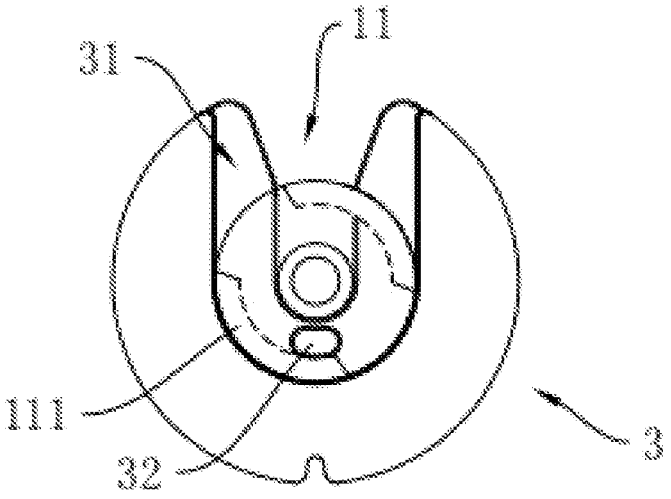
FIG. 16 is a schematic diagram of the hanging disc and dumbbell disc when they cooperate with each other in an embodiment of the application.

Referring to FIGS. 14-16, the hanging disc 11 and the dumbbell disc 3 are engaged through the following solution: each group of hanging discs 11 are integrally provided with an arc hanging strip 111 with gradually increasing or decreasing length. Each dumbbell disc 3 is provided with a U-shaped slot 31 for sliding and clamping of the hanging disc 11, and the inner wall of the U-shaped slot 31 is integrated with the dumbbell disc 3 to integrally form a waist-shaped positioning block 32. Rotating the hanging disc 11, the hanging strip 111 is rotated and clamped between the positioning block 32 and the bottom wall of the U-shaped slot 31, so that the hanging disc 11 is engaged with the dumbbell disc 3. When the end of the hanging strip 111 is clamped into the U-shaped slot 31 to be tangent to the arc surface of the positioning block 32, the hanging disc 11 is half-engaged with the dumbbell disc 3.

Combining with FIG. 17, when the hanging disc 11 is rotated to engage with or disengage from the dumbbell disc 3, the working state of the locking component 41 will be described in detail.

Each group of hanging discs 11 are centered on the handle tube 12 and are respectively a first disc 11*a*, a second disc 11*b*, a third disc 11*c* and a fourth disc 11*d* from inside to outside. Two hanging strips 111 are symmetrically mounted on each hanging disc 11, in particular, the central angle of the hanging strip 111 of the first disc 11*a* is 144°, the central angle of the hanging strip 111 of the second disc 11*b* is 108°, the central angle of the hanging strip 111 of the third disc 11C is 72°, and the central angle of the hanging strip 111 on the fourth disc 11*d* is 36°. The dumbbell disc 3 corresponds to a first dumbbell single-disc 3*a*, a second dumbbell single-disc 3*b*, a third dumbbell single-disc 3*c* and a fourth dumbbell single-disc 3*d* from the inside to the outside. The corresponding central angle between the top of two adjacent convex blocks 421 or the bottom walls of two adjacent escape grooves 422 is 36°. The dumbbell has the following five positions in total, and the five positions can be adjusted cyclically.

Neutral position (no hanging disc): the grip bar assembly 1 is unloaded and placed on the dumbbell seat 2. At the same time, the hanging disc 11 does not engage with any dumbbell disc 3.

First position (engaging two dumbbell discs): the handle tube 12 is counterclockwise rotated by 36°, and the first disc 11*a* is engaged with two first dumbbell single-disc 3*a*.

Second position (engaging four dumbbell discs): the handle tube 12 is continued to be counterclockwise rotated by 36°, the first disc 11*a* is engaged with two first dumbbell single-discs 3*a*, and the second disc 11*b* is engaged with two second dumbbell single-discs 3*b*.

Third position (engaging six dumbbell discs): the handle tube 12 is continued to be counterclockwise rotated by 36°, the first disc 11*a* is engaged with two first dumbbell single-discs 3*a*, the second disc 11*b* is engaged with two second dumbbell single-discs 3*b*, and the third disc 11*c* is engaged with two third dumbbell single-discs 3*c;*

Fourth position (engaging eight dumbbell discs): the handle tube 12 is continued to be counterclockwise rotated by 36°, the first disc 11*a* is engaged with two first dumbbell single-discs 3*a*, the second disc 11*b* is engaged with two second dumbbell single-discs 3*b*, the third disc 11*c* is engaged with two third dumbbell single-discs 3*c*, and the fourth disc 11*d* is engaged with two fourth dumbbell single-discs 3*d*.

After the fourth position, the handle tube 12 is continued to be counterclockwise rotated, and it will automatically jump to the neutral position. The position is adjusted according to the cycle sequence of "neutral position-one-two-three-four". If the handle tube 12 is turned clockwise, the position will be adjusted according to the cycle sequence of "four-three-two-one-neutral position".

When the dumbbell is in the above five positions, the locking component 41 abuts against the bottom wall of the escape groove 422, and the grip bar assembly 1 is unlocked and can be lifted. If the dumbbell is between the above two adjacent positions, the locking component 41 abuts against the convex block 421, and the grip bar assembly 1 is locked and cannot be lifted.

Figure 17:
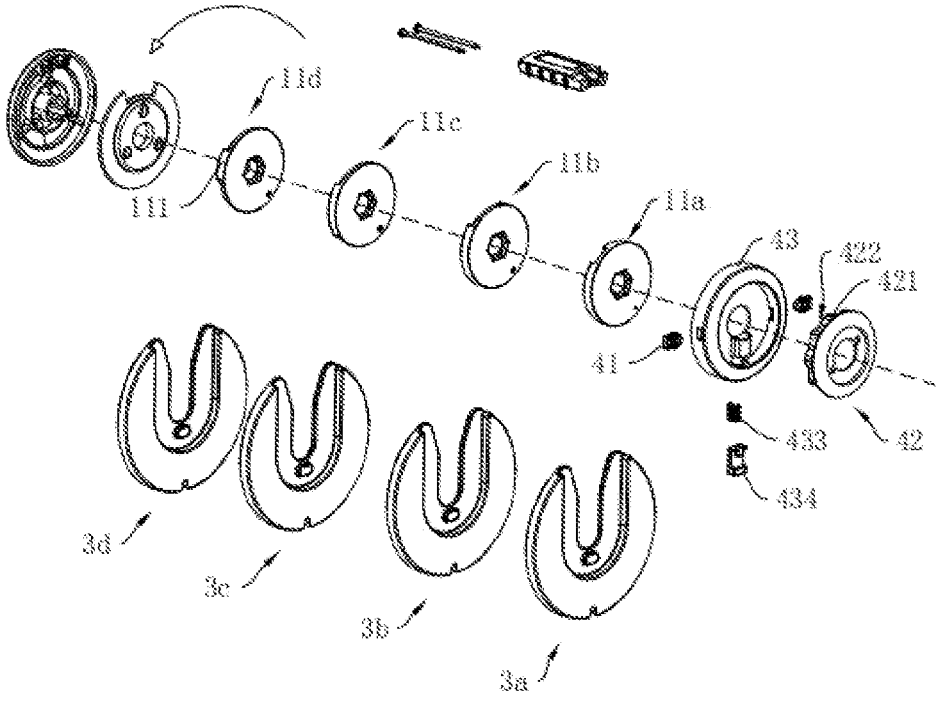
FIG. 17 is a schematic diagram of position adjustment of an embodiment of the present application.
Figure 18:
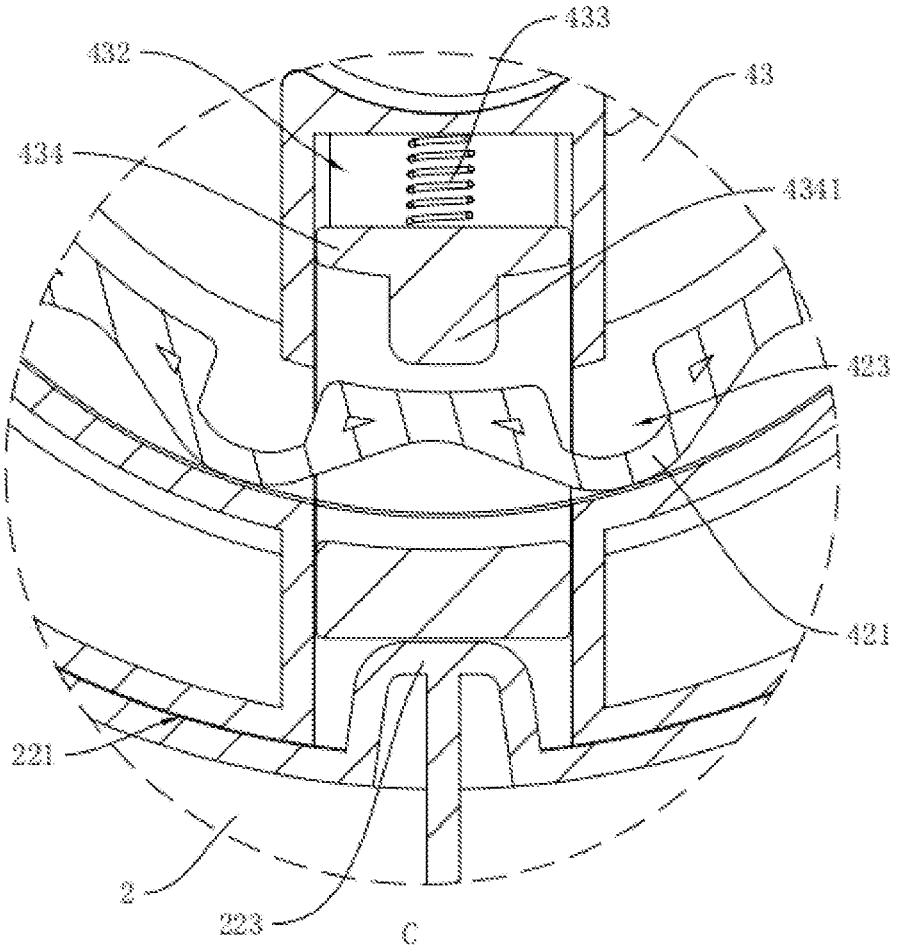
FIG. 18 is an enlarged view at C in FIG. 10 of an embodiment of the present application.

Referring to FIGS. 17-18, the stopping mechanism 4 also includes an anti-rotating component 434 sliding radially along the radial direction of the inner end cap 43. The inner wall of the stopping plate 42 is evenly formed with an anti-rotating slot 423 corresponding to the convex block 421 in the circumferential direction. When the anti-rotating component 434 is clamped into the anti-rotating slot 423, the stopping plate 42 is fixed relative to the inner end cap 43. When the anti-rotating component 434 is disengaged from the anti-rotating slot 423, the stopping plate 42 can rotate relative to the inner end cap 43.

Specifically, a mounting slot 432 is formed on the inner end cap 43 along the radial direction, and the anti-rotating component 434 is slidably installed in the mounting slot 432. A compressing spring 433 is also mounted in the mounting slot 432. One end of the compressing spring 433 is abutted against the groove wall of the mounting slot 432, and the other end of the compressing spring 433 is abutted against the anti-rotating component 434. An anti-rotating block 4341 is integrally arranged on the anti-rotating component 434. Under the action of the compressing spring 433, the anti-rotating component 434 always has a movement trend away from the axis of the inner end cap 43, so that the anti-rotating block 4341 can be clamped into the anti-rotating slot 423.

Meanwhile, the dumbbell seat 2 is integrally arranged with a top block 223, which is positioned on the bottom wall of the clamping groove 221 and corresponds to the mounting slot 432. When the grip bar assembly 1 is positioned on the dumbbell seat 2, the top block 223 is inserted into the mounting slot 432 and abuts against the anti-rotating component 434, the compressing spring 433 is compressed, and the anti-rotating block 4341 slides out of the anti-rotating slot 423, so that the stopping plate 42 can synchronously rotate with the inner end cap 43. When the grip bar assembly 1 is removed from the dumbbell seat 2, the top block 223 is disengaged from the mounting slot 432, the anti-rotating component 434 slides radially along the radial direction of the inner end cap 43 driven by the compressing spring 433, and the anti-rotating block 4341 is clamped into the anti-rotating slot 423, so that the stopping plate 42 is fixed the inner end cap 43.

The implementation principle of a weight-adjustable dumbbell in the embodiment of the application is:

When the grip bar assembly 1 is positioned on the dumbbell seat 2 to adjust the position, the guiding hole 431 is aligned with the limit hole 222. The user drives the hanging disc 11 to rotate synchronously by rotating the handle tube 12, thereby hang or disengage the dumbbell disc 3. At the same time, the stopping plate 42 is rotated synchronously with the handle tube 12. During the rotation of the stopping plate 42, when the hanging disc 11 is half-hung with the dumbbell disc 3, the convex block 421 is aligned with the guiding hole 431, and the locking component 41 abuts against the convex block 421 and slides into the limiting hole 222 in a locked state. When the hanging disc 11 is engaged with the dumbbell disc 3, the escape groove 422 is aligned with the guiding hole 431, and the locking component 41 abuts against the bottom wall of the escape groove 422 and slides out of the limiting hole 222 driven by the resetting portion 413, then it is in the unlocked state.

The above are the preferred embodiments of the present application, which are not intend to limit the protection scope of the present application. Therefore, all equivalent changes made according to the structure, shape and principle of the present application should be covered within the protection scope of the present application.

What is claimed is:

1. A weight-adjustable dumbbell, comprising:

a grip bar assembly, a dumbbell seat, and a plurality of dumbbell discs placed on the dumbbell seat; wherein the grip bar assembly comprises a plurality of hanging discs, the plurality of hanging discs are arranged adjacent to each other and are configured to be rotated synchronously with the grip bar assembly, and the plurality of hanging discs are adapted to be rotated to a plurality of setting positions relative to the plurality of dumbbell discs, wherein each of the plurality of hanging discs is adapted to engage with or disengage with a respective one of the plurality of dumbbell discs at each of the plurality of setting positions;

the grip bar assembly further comprises at least one stopping mechanism, the at least one stopping mechanism comprises at least one locking component, and the dumbbell seat is provided with a limiting hole for the at least one locking component to be engaged with, wherein when the plurality of hanging discs are rotated to one of the plurality of setting positions, the at least one locking component is disengaged from the limiting hole to maintain an unlocked state, and when the plurality of hanging discs are rotated between two of the plurality of setting positions, the at least one locking component is inserted into the limiting hole to maintain a locked state;

the at least one stopping mechanism further comprises an inner end cap and a stopping plate, wherein the inner end cap is configured to be clamped on the dumbbell seat and is rotated relative to the plurality of hanging discs, the stopping plate is provided in the inner end cap and is rotated synchronously with the plurality of hanging discs, the inner end cap is formed with a guiding hole, the at least one locking component is extended through the guiding hole and slidably abutted against the stopping plate, and the stopping plate rotationally drives the at least one locking component to slide back and forth in the guiding hole to engage with or disengage from the limiting hole of the dumbbell seat;

the stopping plate is evenly provided with a plurality of convex blocks along a circumferential direction, and an escape groove is formed between each two adjacent convex blocks;

the at least one locking component comprises an abutting portion abutted against the stopping plate, wherein when the abutting portion abuts against one of the plurality of convex blocks, the at least one locking component is inserted into the limiting hole, and when the abutting portion abuts against a bottom wall of one of the escape grooves, the at least one locking component disengages from the limiting hole;

the guiding hole is formed along a radial direction of the inner end cap, and the plurality of convex blocks are evenly arranged on a circumferential side wall of the stopping plate along the circumferential direction;

the at least one locking component further comprises a locking portion and a resetting portion, wherein the resetting portion is connected to a peripheral side of the locking portion, and the locking portion is extended through the guiding hole and is adapted to slide and engage in the limiting hole, and wherein the resetting portion slides and engages in the guiding hole and drives the locking portion to be reset into the guiding hole;

the resetting portion comprises a connecting section and a limiting section, wherein the limiting section and the locking portion are provided at intervals, and the connecting section is connected between the limiting section and the locking portion; and the guiding hole comprises a sliding cavity and a limiting cavity which are connected, wherein the connecting section is slidably extended through the sliding cavity and the limiting section is slidably extended through the limiting cavity for limiting the connecting section to slide out to one side of the sliding cavity away from the limiting cavity.

2. The weight-adjustable dumbbell according to claim 1, wherein the dumbbell seat comprises a chassis and at least one supporting frame protruding on the chassis, the at least one supporting frame is provided with a clamping slot for the inner end cap of the at least one stopping mechanism to be engaged with, and the limiting hole is formed on a slot wall of the clamping slot.

3. The weight-adjustable dumbbell according to claim 1, wherein the grip bar assembly further comprises a handle tube, and the stopping plate of the at least one stopping mechanism is clamped and sleeved outside the handle tube and is rotated synchronously with the handle tube.

* * * * *